US006595752B2

(12) United States Patent
McGinn et al.

(10) Patent No.: US 6,595,752 B2
(45) Date of Patent: Jul. 22, 2003

(54) RADIAL IMPELLER FOR A CENTRIFUGAL PUMP

(76) Inventors: John McGinn, 7910 7th Ave., Kenosha, WI (US) 53143; Leroy S. Finnigan, 908 72nd Ave., Kenosha, WI (US) 53143

( * ) Notice: Subject to any disclaimer, the term of this patent is extended or adjusted under 35 U.S.C. 154(b) by 0 days.

(21) Appl. No.: 09/901,194

(22) Filed: Jul. 9, 2001

(65) Prior Publication Data

US 2003/0007871 A1 Jan. 9, 2003

(51) Int. Cl.[7] ..... F04D 29/30
(52) U.S. Cl. ..... 416/179; 416/223 R
(58) Field of Search ..... 416/197, 223 B, 416/223 R, 243, DIG. 2, 179, 182, 183, 238

(56) References Cited

U.S. PATENT DOCUMENTS

| | | | | |
|---|---|---|---|---|
| 2,244,397 A | * | 6/1941 | Bour | |
| 4,109,872 A | * | 8/1978 | Couture | 241/46.11 |
| 5,078,275 A | * | 1/1992 | Chupka et al. | 209/273 |
| 5,106,263 A | * | 4/1992 | Irie | 415/206 |
| 5,490,763 A | * | 2/1996 | Abrams et al. | 415/206 |
| 5,501,523 A | | 3/1996 | Weetman et al. | 366/263 |
| 5,511,881 A | | 4/1996 | Post et al. | 366/263 |
| 5,667,383 A | * | 9/1997 | Mendoza et al. | 433/114 |
| 5,755,554 A | | 5/1998 | Ryall | 415/199.4 |
| 5,770,149 A | * | 6/1998 | Raible | 422/46 |
| 5,795,127 A | | 8/1998 | DeClerck | 415/106 |
| 6,368,083 B1 | * | 4/2002 | Wampler | 417/423.7 |

* cited by examiner

*Primary Examiner*—Edward K. Look
*Assistant Examiner*—James M McAleenan
(74) *Attorney, Agent, or Firm*—McAndrews, Held & Malloy, Ltd.

(57) ABSTRACT

An improved impeller for a centrifugal pump is disclosed. The impeller is particularly suited for use in pumps in which a high head is required and in which only low shear forces must be applied to the fluid moving through the pump. The impeller comprises vanes which sweep an arc around an impeller axis to provide a smooth path past the impeller and through the pump. The vanes of the impeller are formed to cause the fluid moving over the vanes to apply a hydrodynamic force to the vane that opposes the force applied to the vane by fluid as the vane urges fluid through the pump. An impeller according to this invention does not require the supporting structures that are required by known impellers.

4 Claims, 2 Drawing Sheets

RADIAL IMPELLER FOR A CENTRIFUGAL PUMP

FIELD OF THE INVENTION

This invention relates to centrifugal pumps having impellers of radial, Francis vane, mixed flow, and axial flow design. In particular, this invention relates to an impeller for centrifugal pumps that is capable of producing a high head while pumping liquids of high viscosity and that is capable of pumping liquids having suspended solids without applying damaging forces to the solids.

BACKGROUND OF THE INVENTION

A centrifugal pump conventionally has an impeller that rotates within a cavity in the body of the pump. Fluid flows to the impeller near its center of its rotation. Rotation of the impeller forces fluid to flow radially outward to an outlet from the cavity at a location that is radially adjacent to the impeller. Known centrifugal pump impellers have several recognized limitations and problems. One problem of such pumps is that operation to produce a high head output applies a significant force to the impeller that urges the impeller along its axis toward the pump inlet. The impeller must be supported sufficiently to carry the axial force without excessive displacement that will adversely affect the operation of the pump or diminish the satisfactory operational life of the pump.

Conventionally, the axial force applied to the impeller of a centrifugal pump is supported through the impeller drive shaft on which the impeller is mounted. The impeller drive shaft extends from the impeller through the pump body. Bearings that will support an axial load are used to support the impeller drive shaft and are mounted within the pump body. The pump body is sufficiently strengthened to support the impeller axial load that is transferred thought the impeller shaft and bearings. Alternatively, the axial force applied to the impeller may be supported by directly coupling the impeller drive shaft to the shaft of a motor that is constructed to support an axial force applied to the motor shaft. Whether the axial force is supported by a directly coupled motor or by a bearing in a strengthened pump housing, the structure that must be provided to support the axial load increases the cost of the pump.

Another problem of known centrifugal pumps is that operating the pump at high speed to produce a high head output causes a significant shearing force to be applied to fluid that flows through the pump. High viscosity fluids resist shearing forces and apply a significant load to the impeller when subjected to high shearing forces. This shearing force limits the use of such pumps to low pump speed and low output head for applications in which the fluid moving through the pump should not be subjected to such shearing forces. Fluid having high solids content, such as those that may be found in food processing systems, pharmaceutical processing systems, or clay slurries, are examples of applications in which a high shearing force may be unacceptable due to the potential for damaging the solids within the fluid. Such concerns either limit the pumping capacity of the centrifugal pumps in such systems or may preclude use of such pumps.

There is a need for an improved impeller centrifugal pump that overcomes the disadvantages and limitations of conventional impeller centrifugal pumps. In particular, there is a need for an improved impeller pump that does not require the expensive structure and mechanical components that support the axial load applied to the impeller of the conventional impeller centrifugal pumps. Further, there is a need for an improved impeller centrifugal pump that can operate at high speeds and produce a high head with less shear forces than current designs allow.

SUMMARY OF THE INVENTION

The present invention overcomes disadvantages and limitations of known impeller centrifugal pumps. The present invention provides an impeller for a centrifugal pump that is subject to lower axial forces during operation than prior impellers. This invention also provides an impeller for a centrifugal pump that subjects fluid moving through the pump to lower shear forces than do known centrifugal pump impellers.

More particularly, the impeller of the present invention has vanes having the radial edges formed into a hydrofoil that creates "lift" as fluid moves over the radial edge of the vane. The "lift" is applied to the impeller vane in a direction that opposes the axial force that is applied to the vane as a result of the impeller forcing fluid from the center to the radial edges of the impeller.

In another aspect, the vanes of an impeller according to the present invention limit the forces applied to fluid flowing past the impeller. The vanes are configured to have a circumferential width and axial length that directs fluid past the impeller along a smooth path thereby avoiding the shearing forces associated with abrupt changes in the flow path of a fluid. In addition, each vane has a cross section which creates an extended slip path from the high pressure side of the vane to the low pressure side of the vane. This extended slip path improves the efficiency of the impeller by reducing the amount of fluid that can move from the high pressure side of the vane to the low pressure side of the vane within the pump. Reducing fluid recirculation within the pump from the high pressure side of the vane to the low pressure side of the vane reduces the amount of shearing forces felt by the fluid.

Accordingly, it is an object of the present invention to provide an impeller for a centrifugal pump that will create a lower axial force during operation than prior impellers for radial impeller centrifugal pumps. This is accomplished by incorporating a hydrofoil that creates a lift force applied to the impeller in a direction that opposes the axial force created by the action of the impeller forcing fluid through the pump.

It is yet another object of the present invention to provide an impeller for a centrifugal pump that forces fluid through the pump along a path that is sufficiently smooth to avoid the high shear forces in the fluid that result from abrupt changes in direction of flow through the pump.

It is still another object of the invention to provide an impeller for a centrifugal pump that reduces recirculation of fluid within the pump.

These and other objects and advantages of the present invention will be understood from the following description and drawings of an embodiment of an impeller according to the present invention.

DETAILED DESCRIPTION OF THE PREFERRED EMBODIMENT

Figure 1:
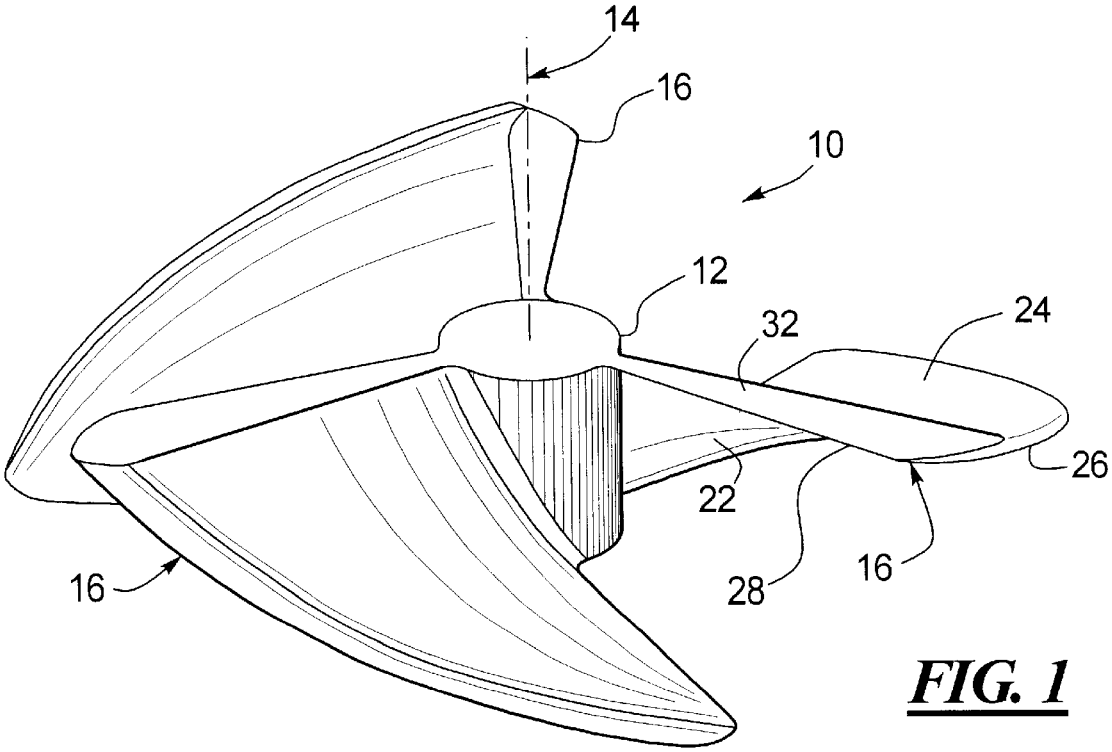
FIG. 1 is an isometric view from the inlet side of an impeller according to the present invention.
Figure 2:
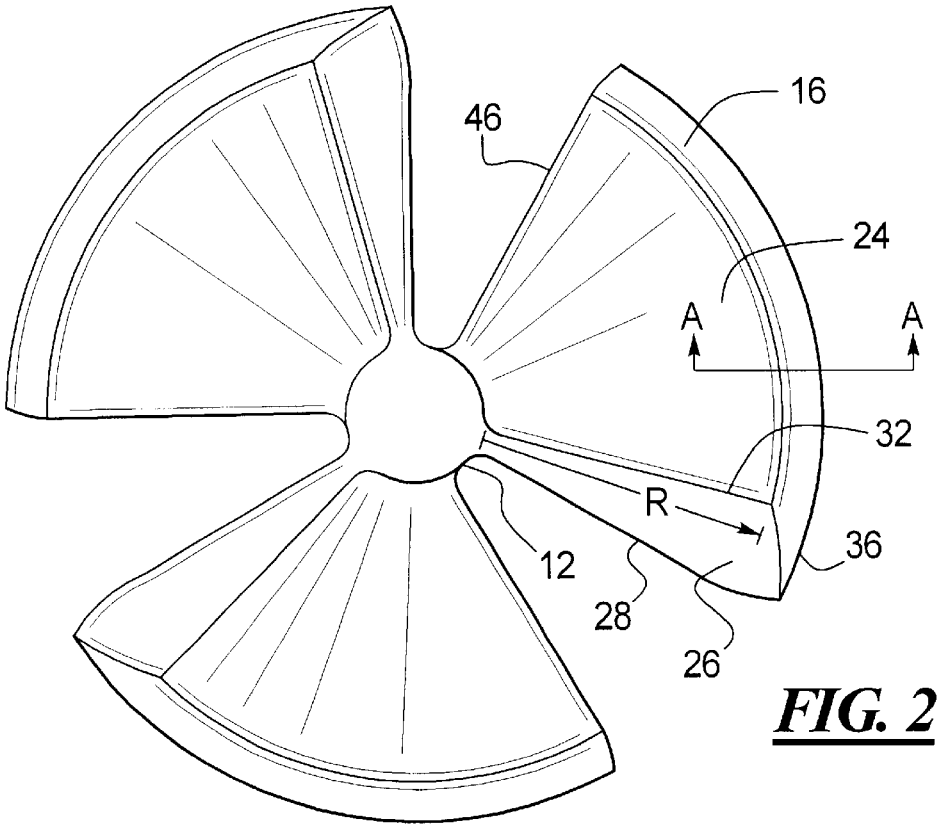
FIG. 2. is a view of the impeller of FIG. 1 from the inlet side of the impeller.
Figure 3:
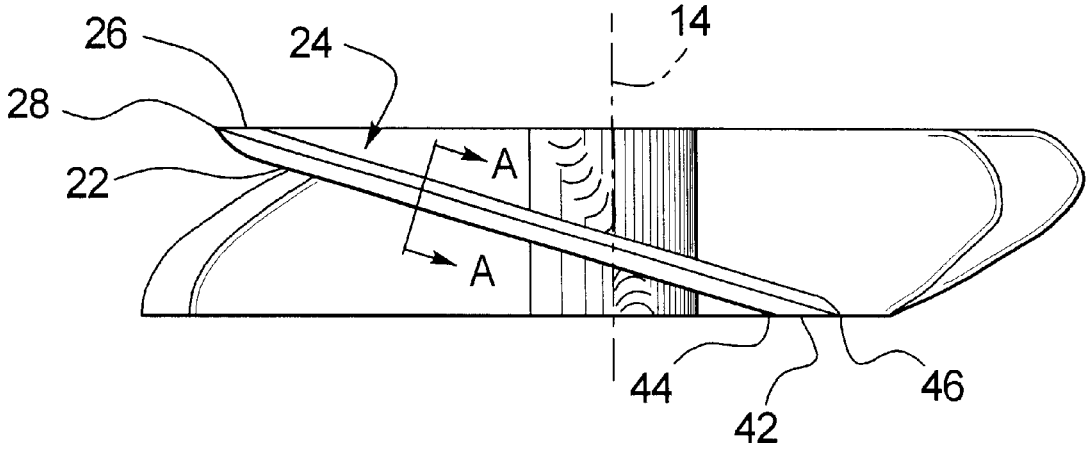
FIG. 3 is a side elevation view of the impeller of FIG. 1.

As presently preferred, the present invention is embodied by a radial impeller having two or three vanes. A three vane radial impeller 10 according to the present invention is shown by FIG. 1. The impeller 10 includes a generally cylindrical hub 12 lying along an impeller axis 14. The hub 12 is adapted, as is well known in the art, to mount to an impeller shaft (not shown) that drives the impeller 10 to rotate about the impeller axis 14 in a circumferential rotation direction Ro shown by FIG. 2. The impeller 10 has three vanes 16 extending radially outwardly from the hub 12 from three locations spaced equidistantly around the circumference of the hub 12. The three vane design is preferred as enhancing overall hydraulic balance of the impeller. Each vane 16 defines a high pressure surface 22 and a low pressure surface 24. As best shown by FIG. 2, the low pressure surface 24 faces partially outwardly along the impeller axis 14 toward a pump inlet. The high pressure surface 22 faces partially along the impeller axis 14 away from the pump inlet.

Each vane 16 has an upper vane surface 26 that lies in a plane that is perpendicular to the impeller axis 14. The upper vane surface 26 meets the high pressure surface 22 along a leading edge 28 and meets the low pressure surface 24 along a trailing edge 32. Each vane 16 extends along the hub 12 to a lower vane surface 42 that lies in a plane perpendicular to the impeller axis 14. The lower vane surface 42 meets the high pressure surface 22 at a lower leading edge 44. The lower vane surface 42 meets the low pressure surface 24 at a lower trailing edge 46.

Each vane 16 extends along the hub 12 from the upper vane surface 26 to the lower vane surface 42 and sweeps an arc around the hub 12 in a circumferential direction from the leading edge 28 toward the trailing edge 32 that is opposite the circumferential rotation direction Ro. As best shown by FIG. 2, the vane 16, as presently preferred, sweeps an arc around the impeller axis 14 of approximately ninety degrees from the leading edge 28 of the upper vane surface 26, to the lower trailing edge 46. As also presently preferred, the impeller height in the direction of the impeller axis 14 from the upper vane surface 26 to the lower vane surface 42 is 2 and ½ inches. The arc swept by the vane 16 extends the high pressure surface 22 and thereby decreases the shear forces applied to fluid moved by the impeller 10 to diminish damage that such forces may cause. The sweep of the vane 16 and ratio of swept arc to impeller height provides gentle re-direction of the liquid inside the casing reducing abrupt changes of liquid direction and increasing overall pump efficiency.

As best shown by the leading edge 28 and trailing edge 32 in FIG. 2, each vane 16 is formed so that the distance between the high pressure surface 22 and low pressure surface 24 increases as the distance from the hub 12 increases to a distance R. From the distance R to the outer radius of the vane 16, the high pressure surface 22 and the low pressure surface 24 converge toward each other to meet at an outer vane edge 36 at the farthest radial extent of the vane 16 from the hub 12. This profile increases the length of the slip path along the high pressure surface 22 in a direction outwardly from the hub 12 toward the vane edge 36 as compared to a vane surface of uniform thickness. The longer slip path decreases the amount of fluid that can travel over the high pressure surface to and around the vane edge 36 to the low pressure surface and thereby reduces recirculation around the impeller 10 and increases pumping efficiency.

The arc swept by the vane 16 around the hub 12 increases the width of the vane with increasing distance from the hub 12. Increasing the arc increases the cross sectional area between vanes and the area of the high pressure surface 22 and the low pressure surface 24 and increases the length of the path of fluid flow along the high pressure surface 22. The arc described above increases the cross sectional area between vanes and is specified to induce laminar flow of fluids. The arc may be increased or a vane removed to assist in inducing laminar fluid flow through the pump.

Reducing recirculation around the vane edge 36 reduces the chances of damaging any fluid and solids entrained in the fluid. The wide slip path on vane surfaces 22 and 24 makes the transit of the liquid from the high pressure side of the impeller to the low pressure side difficult. In addition to the wide area of the slip path, a tight mechanical tolerance between the pump cavity and the vane lower vane surface 42 makes this design highly efficient as it reduces the liquids ability to recirculate inside the pump.

Figure 4:
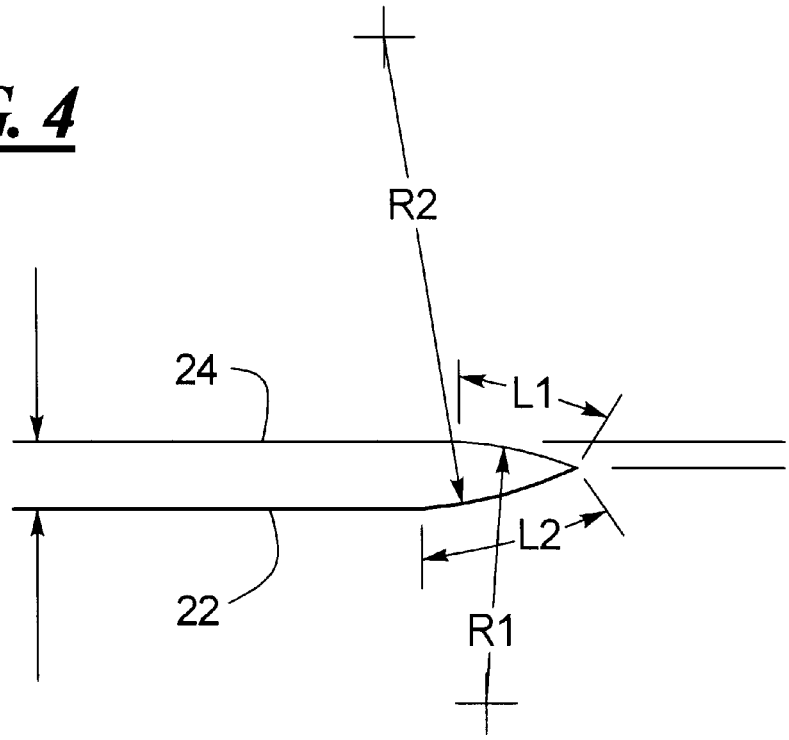
FIG. 4 is a cross section view taken along the line A—A of FIGS. 2 and 3.

As best shown by FIG. 4, the high pressure surface 22 and the low pressure surface 24 form a hydrofoil as they converge to meet each other at the vane radial edge 36. That hydrofoil causes the fluid moving past the vane 16 to impose a "lift" force that urges the vane 16 away from the pump inlet, thereby opposing the force applied to the vane as a result of pressure applied to the high pressure surface 22. The hydrofoil profile is specified by the radius of the arc R1 and the length of the arc L1 of the low pressure 24 surface as it approaches the high pressure surface 22, and the radius of the arc R2 and length of the arc L2 of the high pressure surface 22 as it approaches the low pressure surface 24. As presently preferred for the impeller 10 as described, the thickness of the vane 16 measured perpendicularly from the high pressure surface 22 to the low pressure surface 24 is 0.375 inches. For this vane, as presently preferred, R1 is 1.5181 inches, L1 is 0.6313 inches, R2 is 2.8194 inches, and L2 is 1.1724 inches.

The impeller of this invention provides a centrifugal impeller which can pump high solids/viscous liquids with high efficiencies and low product damage. It can provide high heads/discharge pressures at lower axial thrust loads. The helical vane sweep and foil, induces laminar flow and reduces axial thrust. The impeller vanes reduce recirculation and assist inducement of laminar flow. This impeller therefore requires less power and reduces axial thrust thereby increasing the life of bearings and motors that move and support the impeller within a pump.

The present invention has been described by reference to preferred embodiments of the invention. It will be understood by those skilled in the art that the described embodiments do not limit the invention and that the invention may be practiced other than as by the described embodiments. The invention encompasses all sizes, configurations, alternatives, modifications, and equivalents with the scope of the appended claims.

What is claimed is:

1. An impeller for a centrifugal pump comprising:

a hub extending along an impeller axis, the impeller axis defining an axial direction along the hub;

two vanes extending from the hub in a radial direction away from the impeller axis to a radial vane edge at the farthest extent of the vane from the hub;

each vane extending along the hub in the direction of the impeller axis from an upper location to a lower location, the direction along the impeller axis from the upper location to the lower location defining an axial inlet direction;

each vane extending around the hub in a first circumferential direction to sweep an arc from an upper location along the impeller axis to a lower location along the impeller axis;

each vane defining:

a high pressure surface facing at least partially along the axial inlet direction, the high pressure surface extending from a high pressure surface leading edge at the upper location in the axial inlet direction in the first circumferential direction to a high pressure surface trailing edge at the lower location, the high pressure surface leading edge and the high pressure surface trailing edge extending outwardly from the hub away from the impeller axis, a low pressure surface facing at least partially along the impeller axis in a second axial direction that is opposite the axial inlet direction, the low pressure surface separated from high pressure surface in the first circumferential direction, the separation between the high pressure surface and the low pressure surface in the first circumferential direction increasing with distance from the impeller axis to a first location closely adjacent to the radial vane edge;

the low pressure surface and high pressure surface forming a hydrofoil between the first location and the radial vane edge that causes a fluid moving radially outwardly along the low pressure surface and high pressure surface as the impeller rotates about the impeller axis in a direction opposite the first circumferential direction to impose a force on the vane along the axial inlet direction.

2. The impeller of claim 1 wherein the vanes further define:

an upper vane surface adjacent to the upper location and extending from the high pressure surface leading edge to meet the low pressure surface to form an upper vane surface trailing edge; and a lower vane surface adjacent to the lower location extending from the high pressure surface trailing edge to meet the low pressure surface to form a lower vane surface trailing edge.

3. The impeller of claim 2 further comprising three vanes.

4. The impeller of claim 3 wherein the high pressure surface leading edge and the lower vane surface trailing edge of every vane define a generally straight line extending radially away from the impeller axis and each vane sweeps an arc of ninety degrees as measured by the angle between the high pressure surface leading edge and the lower vane surface trailing edge.

* * * * *